US007549912B2

(12) United States Patent
Liang et al.

(10) Patent No.: US 7,549,912 B2
(45) Date of Patent: Jun. 23, 2009

(54) METHOD OF FINISHING CUTTING ELEMENTS

(75) Inventors: Dah-Ben Liang, The Woodlands, TX (US); Ramamurthy K. Viswanadham, Spring, TX (US)

(73) Assignee: Smith International, Inc., Houston, TX (US)

( * ) Notice: Subject to any disclaimer, the term of this patent is extended or adjusted under 35 U.S.C. 154(b) by 162 days.

(21) Appl. No.: 11/197,119

(22) Filed: Aug. 4, 2005

(65) Prior Publication Data

US 2007/0032173 A1 Feb. 8, 2007

(51) Int. Cl.
*B24B 31/108* (2006.01)
*B21K 5/06* (2006.01)
*E21B 10/46* (2006.01)

(52) U.S. Cl. ..... 451/327; 76/108.2; 176/426

(58) Field of Classification Search ..... 175/374, 175/425, 426; 451/32, 86, 97, 104, 113, 451/327, 328, 35; 76/108.1, 108.2, 108.4
See application file for complete search history.

(56) References Cited

U.S. PATENT DOCUMENTS 3,548,960 A * 12/1970 Hasiba ..... 175/393
3,769,757 A * 11/1973 Sunday, Jr. ..... 451/241
4,408,417 A * 10/1983 Kobayashi et al. ..... 451/327
4,869,329 A 9/1989 Kar et al.
4,884,372 A * 12/1989 McNeil ..... 451/327
5,295,330 A * 3/1994 Hoffman ..... 451/328
5,476,415 A * 12/1995 Nishimura et al. ..... 451/326
5,716,170 A * 2/1998 Kammermeier et al. ..... 408/145
6,371,225 B1 * 4/2002 Overstreet et al. ..... 175/374
6,733,374 B2 * 5/2004 Gegenheimer et al. ..... 451/326
6,875,081 B2 * 4/2005 Hoffman ..... 451/32
7,140,947 B2 * 11/2006 Nishimura et al. ..... 451/10
2005/0053511 A1 * 3/2005 Rainey et al. ..... 419/18
2007/0039762 A1 * 2/2007 Achilles ..... 175/434

* cited by examiner

*Primary Examiner*—Kenneth Thompson
(74) *Attorney, Agent, or Firm*—Osha Liang LLP

(57) ABSTRACT

A method for manufacturing drill bit inserts in which the inserts are finished in a centrifugal disc finishing machine. The centrifugal disc finishing machine comprises a configured surface rotating relative to a stationary receptacle, and the inserts may be finished with a mass of materials comprising at least one of a group of media, parts, detergent, and solution. Also, a method of increasing drill bit insert performance comprising accelerating a plurality of inserts in a high-energy finishing machine, wherein the acceleration results in a generally toroidal interaction between the inserts and at least one of the group comprising media, parts, detergent, and solution.

18 Claims, 3 Drawing Sheets

METHOD OF FINISHING CUTTING ELEMENTS

FIELD OF THE INVENTION

The invention relates generally to earth-boring bits used to drill a borehole for the ultimate recovery of oil, gas, or minerals. More particularly, the invention relates to improving the cutting inserts used in roller cone rock bits.

BACKGROUND OF THE INVENTION

An earth-boring drill bit is typically configured on the lower end of a drill string and is rotated by rotating the drill string at the surface or by actuation of downhole motors or turbines, or by both methods. With weight applied to the drill string, the rotating drill bit engages the formation and proceeds to form a borehole along a predetermined path toward a target zone.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disengaging the formation material in its path. Cutters are generally of two types: composite inserts formed from a hard material such as tungsten carbide cemented with a binder such as cobalt, or milled teeth formed as extensions protruding from the surface of the roller cone.

The cost of drilling a borehole is proportional to the length of time it takes to drill to the desired depth and location. In oil and gas drilling, the time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which, again must be constructed section by section. This process, known as a "trip" of the drill string, requires considerable time, effort and expense.

To keep costs down, it is important that the drill bit fails as few times as possible while drilling a borehole. One such cause of drill bit failure is worn or broken cutting inserts. Cutting inserts may fail by either becoming excessively worn, so that the formation is no longer effectively drilled, or by breaking off, wherein the pieces of broken insert contact the roller cone, potentially leading to roller cone failure. Whether becoming excessively worn, or breaking off, insert failure can be attributed to either surface or internal flaws of the insert. Because repairing broken inserts and roller cones is costly and time consuming, significant modifications have been made to the design and manufacturing processes of inserts.

One manufacturing process to improve the strength and life of cutting inserts involves the vibratory finishing of the cutting inserts prior to their press-fitting into the roller cone of a drill bit. During vibratory finishing, inserts are moved in a vibratory bowl or barrel shaped vibrating machine where they constantly contact media and one another. The insert on insert contact, along with the insert on media contact smoothes the surface of the inserts, thereby reducing insert flaws on the cutting inserts. A process disclosing the finishing of inserts in a vibratory finisher is described in U.S. Pat. No. 4,869,329 issued on Sep. 26, 1989 to Kar, hereby incorporated by reference herein. The Kar patent teaches using increased time to improve the toughness of inserts by extending the vibratory tumbling or finishing operations thereon. While the process of vibratory finishing has increased the toughness of inserts, the advantages gained as a result of longer tumbling times are confined to the reduction of the size and distribution of surface flaws due to the limited amount of velocity and/or energy generated by this method.

BRIEF SUMMARY OF THE INVENTION

According to one method of the present invention, inserts for drill bits are finished in a centrifugal disc finishing machine, wherein the centrifugal disc finishing machine comprises a configured surface rotating relative to a stationary receptacle.

According to another method of the present invention, the performance of drill bit inserts is increased by accelerating a plurality of inserts in a high-energy finishing machine. The acceleration results in a generally toroidal interaction between the inserts and at least one of the group comprising media, parts, detergents, and solution.

According to a process of the present invention, a drill bit insert is finished in a centrifugal disc finishing machine. The centrifugal disc finishing machine includes a configured surface rotating relative to a stationary receptacle.

According to an embodiment of the present invention, a finishing device comprises a centrifugal disc finishing machine and a plurality of cutting inserts. A configured surface of the centrifugal disc finishing machine rotates relative to a stationary receptacle, wherein the high-speed rotation of the configured surface relative to the stationary surface results in a toroidal motion of the inserts.

Other aspects and advantages of the invention will be apparent from the following description and the appended claims.

DETAILED DESCRIPTION OF THE INVENTION

Figure 1:
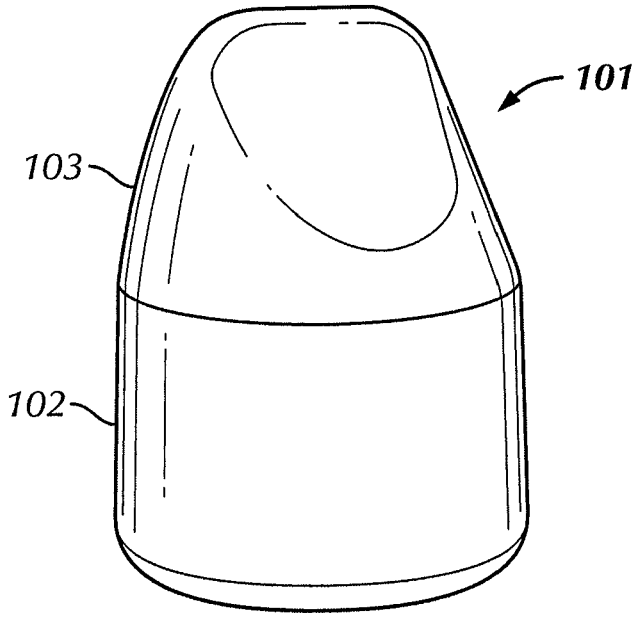
FIG. 1 is a side profile view of a drill bit cutting insert.

Referring initially to FIG. 1, a drill bit cutting insert 101 for use in a roller cone drill bit is shown. Inserts 101 are generally formed with at least two areas, a base 102, configured to be press-fit into the roller cone of a drill bit, and a cutting surface 103, designed to contact a formation during drilling. While cutting surface 103 is illustrated in the shape of a chisel, it should be understood that cutting surfaces of different designs known to those skilled in the art, for example, conical and asymmetric inserts, will also benefit from the present invention.

Still referring to FIG. 1, inserts 101 are typically a composite material made from an abrasion resistant material, for example, tungsten carbide, titanium carbide or tantalum carbide, and a binder, such as cobalt or nickel iron. However, it should be understood that any material benefiting from a high-energy finishing process can be used for inserts 101. For example, fixed drill bits with polycrystalline diamond compact (PDC) cutters, or inserts formed from PDC bonded to an abrasion resistant material, such as those listed above, may also benefit from the present invention. The composite material is pressed into the desired shape in a powered form, sintered through temperature and pressure, and then ground to a specific size and geometry. After grinding, inserts 101 may be left with surface and residual tensile stresses, which may reduce their fracture toughness. Absent adequate finishing processes, surface and internal flaws may result in the failure of cutting inserts 101 during drilling operations.

Figure 2:
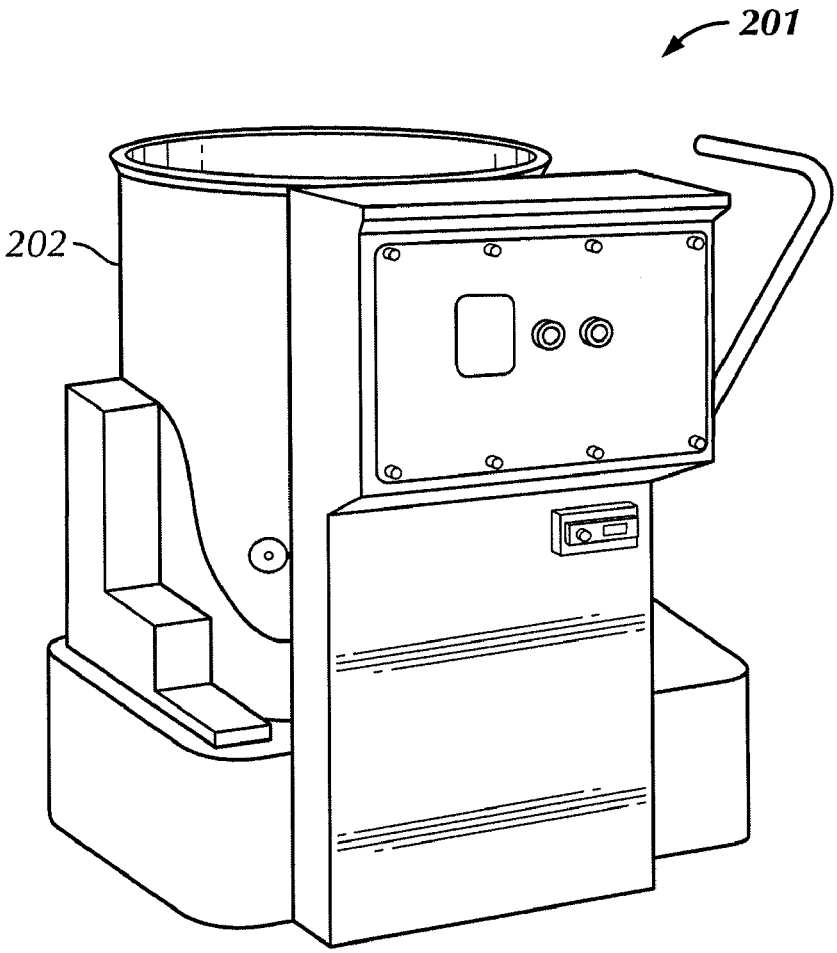
FIG. 2 is an example of a centrifugal disc finishing machine.

Referring to FIG. 2, a centrifugal disc finishing machine 201 is shown. A centrifugal disc finishing machine 201, for example, the SINTO EVF-04, a roll flow finishing machine, also known as a roll flow centrifugal disc finishing machine, accelerates the contents of a stationary receptacle 202 by rotating a configured surface (e.g. 303 of FIG. 3) residing beneath stationary receptacle 202. Examples of stationary receptacles 202 include tubs, barrels, bowls, or any other container capable of holding a "mass" of inserts 101, finishing media, detergent, solution, and dry compounds. As finishing machine 201 is energized, the centrifugal rotational force of the disc causes the mass in stationary receptacle 202 to rotationally rise up and out. The mass comes into contact with the top (not shown) and side walls of stationary receptacle 202 causing it to effectively fall over itself in an inward, downward, and rotational motion. The mass, therefore, forms a hurricane-like vortex acting on itself and on stationary surface 202 in a generally toroidal motion.

Figure 3:
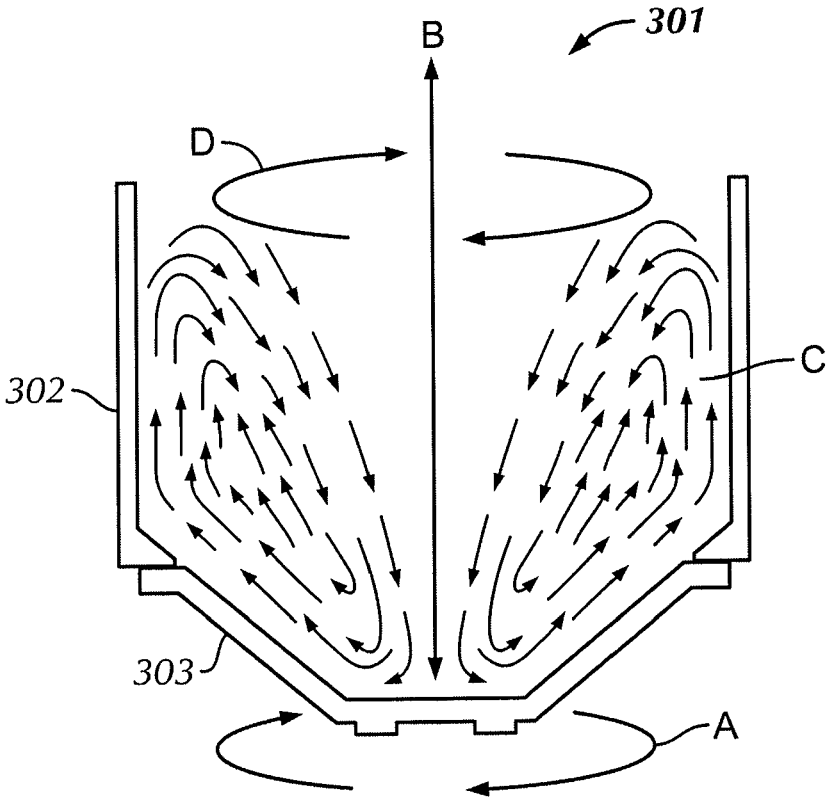
FIG. 3 is an illustration of toroidal motion in a centrifugal disc finishing machine.

Referring now to FIG. 3, an illustration of toroidal motion 301 in a centrifugal disc finishing machine is shown. A stationary receptacle 302 (202 in FIG. 2) is disposed over a rotatable disc 303, such that when rotatable disc 303 is activated, it moves independently from, but without losing contact with stationary receptacle 302. Optionally, a dynamic rotary seal may be disposed between stationary receptacle 302 and rotatable disc 303 to prevent escape of fluids and solids there between. Rotatable disc 303 moves in plane of motion A, illustrated heretofore as motion along a generally circular path. When stationary receptacle 302 is loaded with a mass, and rotatable disc 303 is engaged in plane of motion A, the mass is vertically or rotationally accelerated relative to plane of motion A about axis B such that the mass moves along the paths indicated at C. As the mass travels along path C, it contacts the top and side walls of stationary surface 302 causing it to fall over itself inwardly and downwardly. While the mass moves along path C, it is rotated in direction D, which is substantially the same direction as described by plane of motion A. The combined effect of the mass concurrently moving in directions C and D is exemplary of toroidal motion 301 referenced above.

Toroidal motion 301 provides an advantage over traditional vibratory finishers in that the mass has increased contact with itself and stationary surface 302. Additionally, because the toroidal motion 301 of centrifugal disc finishing machine 201 causes the mass to move faster than in conventional vibratory finishers, the inserts and media collide at greater speeds. The increased contact speed causes more plastic deformation at the insert surface area than prior solutions. To retain cohesion, the insert layers effectively expand under compressive stress, wherein the compressive stresses are compensated for by tensile stresses in the insert core. The result of increasing residual compressive stress is an increase in fatigue resistance and fracture toughness, because compression during the drill process reduces the stress levels on the insert layers where the applied load is the highest (i.e. where the insert contacts the formation). Further, increased residual compressive stresses lead to crack closure, therefore reducing insert fatigue and failure, much like the techniques and benefits from shot-peening and/or laser-peening processes.

Furthermore, the increased collision speeds of high-energy finishing machines may result in higher insert coercivity. Coercive force measures the amount of reverse magnetism required to reduce the residual induction to zero after a sample is removed from a magnetic field where it was completely saturated. The coercivity of cemented carbide is directly related to its mean free path, volume fraction of binder, mean grain size, inclusions, porosity, eta phase, internal stress, and carbon content. During high-energy finishing, work done on the insert surface is increased. The increased work on the inserts may result in higher coercivity, thereby increasing insert hardness, making the insert more resistant to fracture and fatigue.

Centrifugal disc finishing machines 201 are advantageous in that equivalent or better results, relative to vibratory finishers, may be achieved in less time. Prior art finishing machines require substantial manual loading of the mass to be finished along with manual separation of the completed product. Centrifugal disc finishing machines, however, are capable of providing one-hundred percent automated loading and separation. The resources saved in utilizing a finishing machine capable of automated processes allows for a more efficient method of mass finishing.

Because of the centrifugal force caused by the high speed rotation of the bottom disc, embodiments of the present invention provide methods to finish inserts to a higher quality in less time. Specifically, centrifugal disc finishing machine 201 may finish parts in ⅕ to 1/10 the time of prior art finishing machines. Whereas prior art finishing methods, such as the method described in U.S. Pat. No. 4,869,329, teach a finishing process lasting from 90 to 225 minutes, methods in accordance with the present invention may provide the same quality in 15 to 60 minutes. While the time savings result in a more efficient process, an additional advantage of multiple finishing cycles can be understood. Multiple cycle finishing is not limited to high-energy finishing. Rather, varied cycles may be foreseen, wherein a low-energy (conventional) cycle precedes or follows a high-energy finishing process. According to other aspects of the present invention, multiple high-energy finishing processes may be utilized, wherein media, solution, detergent, and differing combinations used to create the mass are changed. Varied mass combinations may provide additional advantages in insert quality not realized in the prior art.

Figure 4:
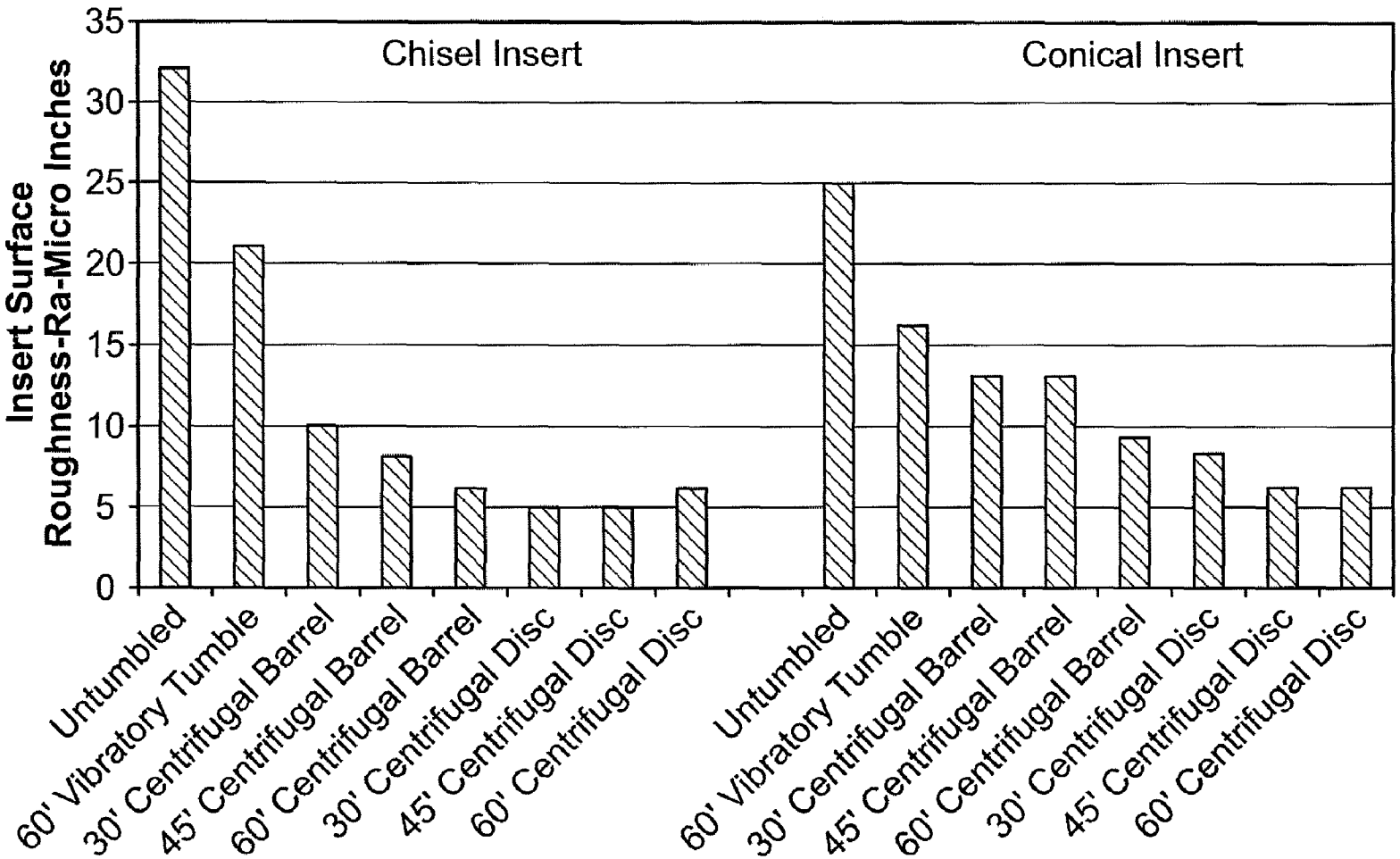
FIG. 4 is a comparison chart illustrating the effect of various finishing techniques on insert surface roughness.

Referring now to FIG. 4, a comparison chart illustrating the effect of various finishing techniques on insert surface roughness is shown. Average surface roughness (Ra) is shown for untumbled inserts, inserts finished in a vibratory tumbler for 60 minutes, and inserts finished in centrifugal barrel and centrifugal disc finishing machines for 30, 45, and 60 minutes respectively. The chart illustrates the effect of various finishing techniques on chisel and conical inserts, but it should be understood that high-energy finishing can be used on any type of drill bit insert known to one skilled in the art. According to FIG. 4, untumbled chisel inserts had an initial surface roughness of 32 Ra, and after 60 minutes of vibratory tumbling had a surface roughness of 21 Ra. While vibratory tumbling decreased surface roughness, centrifugal disc finishing resulted in surface roughness decreases to 5 Ra in 30 and 45 minute finishing cycles, and 6 Ra in 60 minutes cycles. Similarly, untumbled conical inserts had an initial surface roughness of 25 Ra, and after 60 minutes of vibratory tumbling had a surface roughness of 16 Ra. While centrifugal barrel finishing of conical inserts resulted in decreases to 13 Ra in 30 and 45 minute cycles and 9 Ra in 60 minute cycles, centrifugal disc finishing provided surface roughness results of 8 Ra in 30 minutes, and 6 Ra in 45 and 60 minute cycles. The toroidal motion of centrifugal disc finishing results in high levels of work done on insert surfaces, thereby finishing inserts with reduced surface roughness and increased resistance to fracture and fatigue.

To achieve the highest quality inserts in the most efficient manner, incremental adjustments to the mass are sometimes necessary. Prior art finishing machines restrict "on the fly" adjustments, and in so doing, effectively limit the effectiveness of the finishing process. With centrifugal disc finishing, such adjustments during the finishing process are possible due to the ease of removal of the top of finishing machine 201. Thus, the top of centrifugal disc finishing machine 201 may be removed, the inserts inspected, and any combination of the media, detergent, and solution adjusted to meet the desired specifications for the end-product.

Advantageously, a method in accordance with an embodiment of the present invention provides a high-energy environment in which inserts for drill bits may be finished with increased efficiency. Furthermore, high-energy finishing in a centrifugal disc finisher may result in a decreased insert surface roughness. Additionally, increased contact speed between inserts and media result in increased residual compressive stress, thereby increasing fracture resistance. Another advantage of the present invention provides multiple finishing processes in any combination of low-energy and high-energy cycles. Centrifugal disc finishing, in accordance with an embodiment of the present invention, may also result in higher insert coercivity, whereby the increased surface area resulting from a smaller grain size produces a harder insert surface. Finally, embodiments of the present invention allow more efficient methods that decrease finishing time and allow for incremental adjustments.

Centrifugal disc finishing machines, in accordance with an embodiment of the present invention, also provide advantage over other high-energy finishing machines. One such high-energy machine is a centrifugal barrel finisher. Centrifugal barrel finishers operate on the same principle as "ferris wheels." Typical centrifugal barrel finishers have two or more rotary barrels mounted on a rotating turret, whereby during high-speed turret rotation, centrifugal force is exerted on the mass in the barrels. Centrifugal barrel finishing is described in U.S. Patent Application No. 20050053511 published on Mar. 10, 2005 to Rainey, hereby incorporated by reference herein. The Rainey patent teaches using a centrifugal barrel finisher to increase tungsten carbide component performance. However, centrifugal barrel finishers generate high levels of heat and pressure, as well as hot slurries in wet processes, so a time delay and external cooling may be required before the barrels can be unloaded. Centrifugal barrels must also be loaded and unloaded individually, an extensive and time consuming process that lengthens finishing time. Additionally, because the barrels are sealed, mass adjustments are not possible during finishing. Centrifugal disc finishing, in accordance with an embodiment of the present invention, provides advantage over centrifugal barrel finishing due to greater flexibility in loading and unloading procedures and "on-the-fly" adjustability.

While the invention has been described with respect to a limited number of embodiments, those skilled in the art, having benefit of this disclosure, will appreciate that other embodiments can be devised which do not depart form the scope of the invention as disclosed herein. Accordingly, the scope of the invention should be limited only by the attached claims.

What is claimed is:

1. A method to manufacture earth-boring drill bit inserts comprising:

forming the inserts from a composite material comprising an abrasion resistant material and a binder;

grinding the inserts to geometric specification; and finishing the inserts in a centrifugal disc finishing machine for 15 to 90 minutes, wherein the centrifugal disc finishing machine comprises a configured surface rotating relative to a stationary receptacle at a speed of between 100 to 300 revolutions per minute to induce a toroidal motion of the inserts, wherein the toroidal motion induces surface residual compressive stresses to the inserts.

2. The method of claim 1, further comprising:

sintering the formed composite material.

3. The method of claim 1, further comprising placing the inserts in the centrifugal disc finishing machine with a mass of materials, the mass of materials comprising at least one of the group consisting of media, parts, detergent, and solution.

4. The method of claim 3, further comprising adjusting the mass of materials during finishing.

5. The method of claim 1, further comprising loading the centrifugal disc finishing machine in an automated process.

6. The method of claim 1, further comprising unloading the centrifugal disc finishing machine in an automated process.

7. The method of claim 1, further comprising performing a low-energy finishing process prior to finishing the inserts in a centrifugal disc finishing machine.

8. The method of claim 1, further comprising performing multiple centrifugal disc finishing processes.

9. The method of claim 1, wherein finishing with the centrifugal disc finishing machine results in increased fracture toughness of the drill bit inserts.

10. The method of claim 1, wherein finishing with the centrifugal disc finishing machine results in increased fatigue resistance of the drill bit inserts.

11. The method of claim 1, wherein finishing with the centrifugal disc finishing machine results in increased insert crush strength.

12. The method of claim 1, wherein finishing with the centrifugal disc finishing machine results in higher insert coercivity.

13. The method of claim 1, wherein finishing with the centrifugal disc finishing machine results in a decrease in insert surface roughness to less than 10 Ra.

14. The method of claim 1, wherein finishing with the centrifugal disc finishing machine results in increased residual compressive stress to the inserts.

15. The method of claim 1, wherein the inserts comprise polycrystalline diamond.

16. A method to increase drill bit insert performance, comprising:

accelerating a plurality of cutting inserts in a high-energy centrifugal disc finishing machine for 15 to 90 minutes to induce surface residual compressive stresses to the inserts;

wherein the acceleration results in a toroidal motion of the inserts in at least one of a group comprising media, parts, detergent, and solution.

17. The method of claim 16, wherein the toroidal motion is caused by vertical acceleration.

18. The method of claim 16, wherein the toroidal motion is caused by rotational acceleration.

* * * * *